US012662835B2

(12) United States Patent
Zangerle

(10) Patent No.: US 12,662,835 B2
(45) Date of Patent: Jun. 23, 2026

(54) PARKING FACILITY FOR MOTOR VEHICLES

(71) Applicant: Woehr Autoparksysteme GmbH, Friolzheim (DE)

(72) Inventor: Andreas Zangerle, Renningen (DE)

(73) Assignee: Woehr Autoparksysteme GmbH, Friolzheim (DE)

( * ) Notice: Subject to any disclaimer, the term of this patent is extended or adjusted under 35 U.S.C. 154(b) by 728 days.

(21) Appl. No.: 18/096,184

(22) Filed: Jan. 12, 2023

(65) Prior Publication Data

US 2023/0220696 A1 Jul. 13, 2023

Related U.S. Application Data

(63) Continuation of application No. PCT/EP2021/067339, filed on Jun. 24, 2021.

(30) Foreign Application Priority Data

Jul. 13, 2020 (DE) ..... 10 2020 118 417.4

(51) Int. Cl.
*E04H 6/26* (2006.01)
*E04H 6/42* (2006.01)

(52) U.S. Cl.
CPC ..... *E04H 6/26* (2013.01); *E04H 6/42* (2013.01)

(58) Field of Classification Search
CPC .... E04H 6/26; E04H 6/42; E04H 6/34; E04H 6/22; Y02T 10/70; Y02T 10/7072; Y02T 90/14; B60L 53/18
See application file for complete search history.

(56) References Cited

U.S. PATENT DOCUMENTS 10,377,253 B2 * 8/2019 Lee ..... B60L 53/36
10,794,077 B1 * 10/2020 Chang ..... E04H 6/20
(Continued)

FOREIGN PATENT DOCUMENTS

DE 102010050848 A1 5/2012
DE 102017202880 A1 8/2018
(Continued)

OTHER PUBLICATIONS

Search Report received in International Application No. PCT/EP2021/067339 dated Oct. 14, 2021, with translation, 5 pages.

*Primary Examiner* — Nha T Nguyen
(74) *Attorney, Agent, or Firm* — Christopher A. Rothe; CM Law

(57) ABSTRACT

A parking facility for motor vehicles includes a carrying device with parking spaces, reception devices that are movable into a parking position in the parking space and out of it, parking space-side contact elements that are suppliable with electrical energy, arranged on at least some reception devices, and corresponding device-side contact elements and a connection element electrically coupled thereto for connecting to a vehicle positioned on the reception device, where the parking space-side contact elements are arranged movably on the carrying device and/or the device-side contact elements are arranged movably on the reception device, and the contact elements are movable from a base position in the absence of the reception device to a contact position when the reception device assumes the parking position, in which contact position the corresponding contact elements are coupled to one another, and can be brought out of the contact position.

31 Claims, 10 Drawing Sheets

(56) References Cited

U.S. PATENT DOCUMENTS

| | | | | |
|---|---|---|---|---|
| 11,149,461 | B2 * | 10/2021 | Valli | E04H 6/22 |
| 12,421,068 | B2 * | 9/2025 | Perini | B65H 19/12 |
| 2008/0014059 | A1 * | 1/2008 | Jones | E04H 6/14 414/227 |
| 2011/0140658 | A1 * | 6/2011 | Outwater | B60L 53/35 320/109 |
| 2013/0096994 | A1 * | 4/2013 | Jakob | B60L 53/126 705/13 |
| 2015/0042278 | A1 | 2/2015 | Leary | |
| 2016/0375784 | A1 * | 12/2016 | Takatsu | B60L 53/65 320/108 |
| 2017/0018963 | A1 * | 1/2017 | Takatsu | B60L 53/38 |
| 2018/0118043 | A1 * | 5/2018 | Lee | B60L 53/36 |
| 2019/0054832 | A1 * | 2/2019 | Lin | H02J 7/0042 |
| 2020/0009977 | A1 * | 1/2020 | Park | B60L 53/35 |
| 2021/0023955 | A1 | 1/2021 | Schiess et al. | |

FOREIGN PATENT DOCUMENTS

| | | | |
|---|---|---|---|
| DE | 102017214647 | A1 | 2/2019 |
| EP | 2330262 | A2 | 6/2011 |
| JP | H04366283 | A | 12/1992 |
| WO | 2015145067 | A1 | 10/2015 |

* cited by examiner

PARKING FACILITY FOR MOTOR VEHICLES

CROSS-REFERENCE TO RELATED APPLICATIONS

This application is a continuation patent application of International Application No. PCT/EP2021/067339, filed on Jun. 24, 2021 and claims priority to German Application No. 10 2020 118 417.4, filed on Jul. 13, 2020. International Application No. PCT/EP2021/067339 and German Application No. 10 2020 118 417.4 are incorporated by reference herein in their entireties and for all purposes.

FIELD

The present disclosure relates to a parking facility for motor vehicles, in particular for at least partially electrically operated motor vehicles, wherein the parking facility comprises a carrying device with parking spaces for motor vehicles, reception devices for the motor vehicles which can be moved into the parking spaces in a movement direction for assuming a parking position, contact elements arranged on at least some parking spaces, which contact elements can be supplied with electrical energy, and contact elements arranged on at least some of the reception devices and a connection element coupled thereto for connection to a motor vehicle positioned on the reception device.

BACKGROUND

With such parking facilities, the user can transfer the motor vehicle, for example at a transfer position, to a transport device. The vehicle is positioned on a reception device which is transported by a transport device to the desired parking space and is moved into the latter in a movement direction. Conversely, the reception device can be removed from the parking space counter to the movement direction and transported into the transfer position. It is known that in parking spaces, fully or partially (for example, hybrid) electrically operable motor vehicles can be charged for the duration of the storage. The contact elements can be supplied with electricity via a supply line on the carrying device. A battery of the motor vehicle positioned on the reception device can thereby be charged.

The carrying device can, for example, be or comprise a parking rack which is constructed from interconnected carriers in the longitudinal direction, transverse direction and optionally height direction (if more than one parking level is present). The reception devices are, for example, pallets.

An object is to provide a parking facility with a charging option for electrically operated motor vehicles, in which a more versatile assignment of parking spaces is possible.

SUMMARY

In an aspect of the disclosure, a parking facility for motor vehicles is provided. The parking facility comprises:

- a carrying device with parking spaces for the motor vehicles, wherein parking spaces are arranged in at least one direction in one level of the parking facility,
- reception devices for the motor vehicles, which are movable in at least one movement direction relative to a respective parking space into and out of a parking position in the parking space,

- parking space-side contact elements arranged on at least some parking spaces, which contact elements can be supplied with electrical energy, and
- arranged on at least some reception devices, corresponding device-side contact elements and a connection element electrically coupled thereto for connecting to, directly or indirectly, a motor vehicle positioned on the reception device.

The parking space-side contact elements are arranged movably on the carrying device and/or the device-side contact elements are arranged movably on the reception device and the moveable contact elements are configured to be moved from a base position in the absence of the reception device in the parking space into a contact position when the reception device assumes the parking position, in which contact position the corresponding contact elements are electrically coupled to one another, and to be brought out of contact from the contact position. The reception device is movable in the at least one movement direction out of the parking space.

BRIEF DESCRIPTION OF THE DRAWINGS

The foregoing summary and the following description may be better understood in conjunction with the drawing figures, of which.

DETAILED DESCRIPTION

Figure 1:
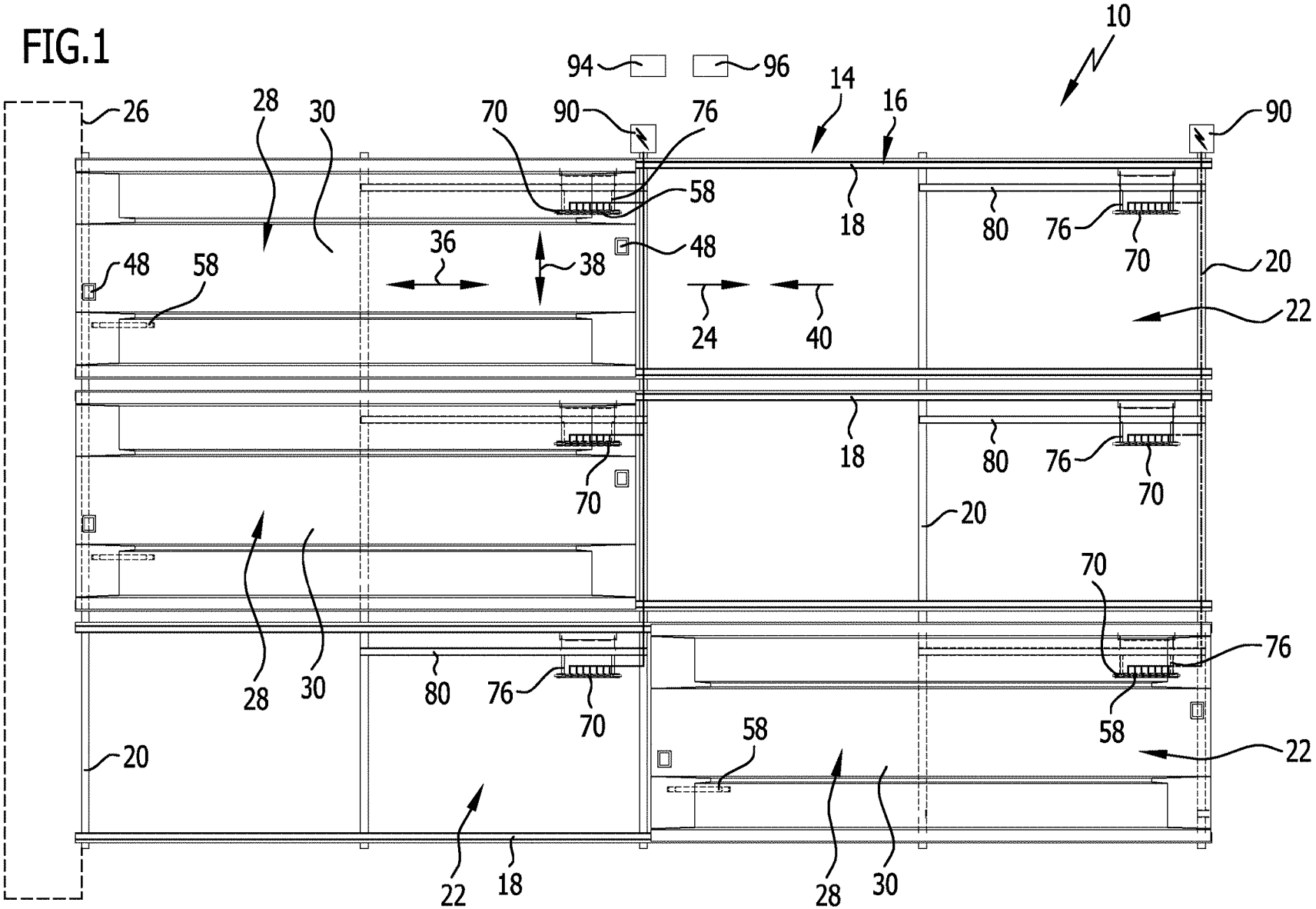
FIG. 1 is a schematic plan view of a level of a parking facility in accordance with the disclosure in a partial depiction, in which level parking spaces and reception devices moved into said parking spaces are shown.

Although the disclosure is illustrated and described herein with reference to specific embodiments, the disclosure is not intended to be limited to the details shown. Rather, various modifications may be made in the details without departing from the disclosure.

The present disclosure relates to a parking facility for motor vehicles, comprising:

a carrying device having parking spaces for the motor vehicles, wherein parking spaces are arranged in at least one level of the parking facility, reception devices for the motor vehicles, which are movable in at least one movement direction relative to a respective parking space into a parking position in the parking space and out of it, parking space-side contact elements arranged on at least some parking spaces, which contact elements are suppliable with electrical energy, arranged on at least some reception devices, corresponding device-side contact elements and a connection element electrically coupled thereto for connecting to a motor vehicle positioned on the reception device, wherein the parking space-side contact elements are arranged movably on the carrying device and/or the device-side contact elements are arranged movably on the reception device and the moveable contact elements are configured to be moved from a base position in the absence of the reception device in the parking space into a contact position when the reception device assumes the parking position, in which contact position the corresponding contact elements are electrically coupled to one another, and to be brought out of contact from the contact position, and wherein the reception device is movable in the at least one movement direction out of the parking space.

In the parking facility in accordance with the disclosure, at least some parking spaces are provided with parking space-side contact elements. If a reception device provided with device-side contact elements is moved into a parking space provided with parking space-side contact elements into the parking position, the contact elements can be moved relative to one another from the base position into the contact position and are connected to one another in an electrically conductive manner. When electrical energy is supplied, a battery of the motor vehicle positioned on the reception device can thereby be charged via the connection element. In addition, there is the advantage that the contact elements are moved relative to one another from the contact position and are brought out of contact with one another, in particular again into the base position. The reception device can be moved out of the parking space in the at least one movement direction. This makes it possible, for example, to occupy the parking spaces provided with contact elements in a targeted manner with reception devices on which vehicles to be charged are positioned. After completion of the charging process, parking spaces with a charging option can be released, for example, and equipped with other vehicles to be charged.

The majority of the parking spaces preferably comprise parking space-side contact elements. In particular, all parking spaces can comprise parking space-side contact elements.

It is understood that the parking facility can comprise a control device. The control device controls, for example, drives for moving the reception devices and for activating electrical devices arranged at the parking spaces in order to supply energy to the parking space-side contact elements.

It is advantageous if two or more parking spaces are arranged one behind the other along at least one movement direction, and when the reception device is movable past the parking space-side contact elements during movement out of the parking space. By placing parking spaces behind one another in at least one movement direction, the available parking space can be compacted. For example, the reception device can first be moved into a first parking space in the movement direction and can be moved past the contact elements of the latter into a parking space downstream in the movement direction. In particular, it is preferably possible to move the reception device past the parking space-side contact elements in at least one movement direction through the parking space.

In the case of the parking facility of the advantageous embodiment mentioned in the last paragraph, it is possible to provide parking spaces positioned in a structurally simple manner one behind the other in the movement direction, of which, for example, at least the front parking spaces in the movement direction are provided with contact elements, past which the reception devices can be moved into at least one parking space arranged behind it without these parking spaces being blocked by contact elements at the upstream parking space and at the reception devices. This offers the possibility, in particular, of providing contact elements on each parking space and/or each reception device and enabling charging processes in each parking space, since the reception devices can be moved past a parking space with contact elements located upstream in the movement direction.

Reception devices can be couplable to one another for moving into parking spaces arranged one behind the other.

In the following, unless otherwise explained, it is assumed that the reception devices comprise electrical contact elements, and contact elements are arranged on the parking spaces.

Preferably, two movement directions are provided which are directed opposite one another. In particular, when moving along each of the movement directions, the reception device can be movable past the parking space-side contact elements out of the parking space. When moving the reception device in the movement direction and counter to the movement direction, there is thus the possibility that the contact elements are coupled to one another in the contact position, and that they are brought out of engagement in order to move the reception device out of the parking space in each of the two movement directions.

It is advantageous if the moveable contact elements are movable from the contact position into the base position when the reception device is moved out of the parking space. After the movement of the reception device, the contact elements can assume the base position at the parking space and can, for example, couple to the contact elements of a further reception device or the device-side contact elements can couple to the contact elements of a further parking space.

It is advantageous if the parking space-side contact elements and/or the device-side contact elements are movable from the base position into the contact position and/or from the contact position by moving the reception device. This enables a structurally simple configuration, wherein the movement of the reception device causes a movement of the contact elements toward one another.

In the above-mentioned advantageous embodiment of the disclosure, drives for the parking space-side and/or the device-side contact elements can in particular be dispensed with so that they can be moved in a drive-free manner from the base position into the contact position and/or from the contact position. This movement free of a drive can be implemented in a technically simple, reliable, low-interference and low-maintenance manner.

It can be provided that only the parking space-side contact elements are arranged movably on the carrying device or only the device-side contact elements are arranged movably on the reception device, whereas the respective other contact elements are arranged in a stationary manner on the reception device or on the carrying device. The design of the parking facility is thereby kept simple by only a part of the contact elements being movable. The number of components, in particular movable components, can be reduced.

For example, the parking space-side contact elements are movably arranged on the carrying device, and the device-side contact elements are held immovably on the reception device.

It is advantageous if the parking space-side contact elements and the device-side contact elements are pretensioned relative to one another in the contact position. This ensures that there is a reliable electrical contact when the reception device is arranged in the parking space and the contact elements assume the contact position.

In particular, pretensioning elements are assigned to the parking space-side contact elements in order to apply a pretensioning force to the contact elements in the direction of the reception device. The parking space-side contact elements are, for example, movably held in at least one holding body in which pretensioning elements are arranged.

It is advantageous if corresponding contact elements in the contact position rub against one another in a contacting manner when the reception device is moved into the parking position and/or out of the parking position. For example, if the contact elements assume the contact position and the reception device is moved out of the parking space, corresponding contact elements can remain in contact with one another at least for a short time and rub against each other. As a result, impurities can be removed from the surfaces of the contact elements, for example, so that even long-term reliable charging processes are ensured.

The parking space-side contact elements and the device-side contact elements preferably comprise pin-shaped contact elements and flat contact elements. In particular, the parking space-side contact elements are pin-shaped, and the device-side contact elements are flat with a larger cross-sectional area in relation to the pin-shaped contact elements.

Preferably, several of the contact elements, and in particular all parking space-side contact elements and/or device-side contact elements are positioned next to one another in a straight line along the movement direction. It is found in practice that in this way a particularly compact design can be achieved for the contact elements on the reception devices and the parking spaces. In particular, the respective contact elements are positioned in a straight line next to one another on the reception devices and on the parking spaces.

Preferably, the reception devices comprise a contact element carrier on which the device-side contact elements are held. In this way, the contact elements can be provided, for example, pre-assembled on the carrier and connected to the reception device. This proves, for example, also to be advantageous for retrofitting existing parking facilities.

The contact element carrier extends preferably longitudinally and is configured in a straight line and, depending on the type of reception device, is oriented along its longitudinal direction or along its transverse direction.

The reception devices typically have a greater extension in the longitudinal direction than in the transverse direction. Vehicles are positioned in the longitudinal direction on the reception device.

It can be provided that a contact element carrier, on which the contact elements are held, and which is held on the carrying device, is assigned to the parking space-side contact elements. As a result, the contact elements can be provided, for example, pre-assembled on the contact element carrier and attached to the carrying device. As in the case of the reception devices, it is possible, for example, to retrofit existing parking facilities.

The contact element carrier is, for example, designed to extend longitudinally and aligned along the movement direction at the parking space, wherein in particular the contact elements are positioned next to one another along the movement direction. The movement direction can be a longitudinal direction of the parking space, in the case of longitudinally moved reception devices, or alternatively a transverse direction, in the case of transversely moved reception devices.

In a preferred embodiment of the disclosure, the contact element carrier is held on a pivot part which is pivotably mounted on the carrying device about a pivot axis. The pivot part is pivotably mounted, for example, on a carrier of a parking rack. Alternatively, a holding part can be provided, for example, which is connected or connectable to the parking rack, for example.

It can be provided that the pivot part forms the contact element carrier.

Stop elements can be provided to limit a pivoting movement of the pivot part relative to the carrying device.

It proves advantageous in practice if the pivot axis is oriented along the at least one movement direction. In particular, the pivot axis can be oriented in the longitudinal direction of the parking space, in the case of longitudinally insertable reception devices, or in transverse directions of the parking space, in the case of transversely insertable reception devices.

The pivot part is advantageously pivotable relative to the carrying device by the movement of the reception device in the at least one movement direction. In this way, the parking space-side contact elements can in particular be transferred from the base position into the contact position and/or removed therefrom and can preferably be transferred again into the base position.

For example, the pivot part with the contact element carrier is arranged below the reception device arranged in the parking space. The reception device can, for example, be moved over the pivot part in order to be moved over the parking space-side contact elements, in a sense to "travel over" them.

Alternatively, the pivot part can, for example, be arranged laterally next to the reception device arranged in the parking space, so that the parking space-side contact elements can be passed laterally when the reception device is moved.

The pivot part is preferably pivotable against the action of a resetting device. This makes it possible to save a drive for transferring the pivot part back into the base position.

In a preferred embodiment of the disclosure, the pivot part comprises two segments arranged on opposite sides of the pivot axis, wherein the contact element carrier is arranged on a first segment and a second segment has or forms a counterweight for the contact element carrier, and wherein the contact element carrier is pivotable against the resetting action of the counterweight. The pivot part forms, for example, a two-armed lever with the contact element carrier on the one side and the counterweight on the other side.

In particular, it can be provided that the torque on the second segment is greater via the counterweight than the torque at the first segment via the contact element carrier. By way of example, the contact element carrier is pivoted, in particular pivoted downward, by the reception device moved into the parking space against the action of the counterweight. If the reception device is moved out of the parking space again, the pivot part pivots under the resetting action of the counterweight, wherein the contact element carrier can be pivoted upwards in particular.

It is advantageous if a coupling element is arranged on the reception device upstream of the device-side contact elements in the at least one movement direction and a corresponding coupling element is arranged on the parking space-side contact elements, which couple when the reception device is moved in the movement direction into the parking space in order to move the contact elements from the base position into the contact position.

When moving the reception device into the parking space, the coupling elements can in particular mechanically couple to one another. For example, the coupling element on the parking space side is positioned upstream of the parking space-side contact elements, opposite to the movement direction of the reception device. By means of the moving reception device, the coupling element on the parking space side is subjected to a force which acts, for example, on the above-mentioned pivot part for pivoting the contact element carrier.

The coupling elements comprise, for example, a ramp and a run-on element that can be abutted on the ramp. The ramp has in particular a tilt at an angle to the movement direction, so that the run-on element can be acted upon by a force transverse to the movement direction.

The run-on element is, for example, a roller rolling on the ramp.

It can prove advantageous, for example, if the ramp is arranged on the reception device, in particular on its contact element carrier, and if the roller is arranged at the parking space, in particular on its contact element carrier.

It is advantageous if the coupling elements are spaced apart from one another when the contact position is assumed by the contact elements and only come into contact again after the reception device has been moved relative to the parking space. If the reception device is moved, the contact elements can thereby rub against each other as mentioned above in order to remove impurities.

In at least one movement direction, the coupling element can be arranged upstream of the device-side contact elements as mentioned.

A further coupling element is preferably arranged on the reception device, leading the contact elements on the device side in an opposite movement direction, and a corresponding further coupling element is arranged on the parking space-side contact elements. These coupling elements couple when the reception device is moved in the further movement direction opposite to the aforementioned movement direction to move the contact elements from the base position to the contact position. As already explained above, the advantages can preferably be achieved during movement of the reception device in two opposite movement directions.

The parking facility preferably comprises a control device and a detection device, by means of which the assumption of the parking position of the reception device in the parking space can be determined, wherein, depending thereon, the control device advantageously activates an electrical switching device arranged on the carrying device for supplying the parking space-side contact elements with electrical energy. For example, the assumption of the parking position is optically detected by the detection device. If a corresponding signal is present, the control device can release the electrical switching device and start the charging process.

The reception devices preferably comprise a receptacle for the connection element in which the connection element is arranged. A connection cable can preferably be stored in the receptacle and can be removed for connecting to the motor vehicle via the connection element. When not in use, the connection element can be stored together with the connection cable in the receptacle and, for example, a cover of the receptacle can be closed. The connection element can be a plug or a socket.

If a connection cable is provided, the receptacle preferably comprises a retraction device for the connecting cable.

A "type 2" and/or a CEE connection element can be provided as a connection element, for example.

The receptacle preferably does not protrude beyond an upper contour of the reception device.

The reception devices can be longitudinally movable reception devices, wherein the at least one movement direction runs in a longitudinal direction of the reception devices.

The device-side contact elements are preferably arranged next to one another in the longitudinal direction.

In the longitudinally movable reception device, the device-side contact elements are advantageously arranged eccentrically with respect to a central longitudinal plane and/or a central transverse plane on the reception device. For example, the contact elements are positioned relative to the extension in the longitudinal direction in the region of a last third, a last quarter, or preferably a last fifth. The connection element is preferably arranged on or near a transverse side of the reception device.

Alternatively or in addition, it can be provided that the reception devices comprise transversely movable reception devices, wherein the at least one movement direction runs in a transverse direction of the reception devices.

In this case, the device-side contact elements are preferably arranged next to one another in the transverse direction.

In the case of transversely movable reception devices, the device-side contact elements can preferably be arranged eccentrically with respect to a central transverse plane and/or symmetrically to one another with respect to a central longitudinal plane on the reception device. The connection element is advantageously arranged on or near a longitudinal side of the reception device.

In the case of transversely movable reception devices, the device-side contact elements are arranged, in relation to the extension of the reception devices of the longitudinal direction, for example in the region of a last third, a last quarter or preferably a last fifth.

It is advantageously provided in particular that the device-side contact elements and the parking space-side contact elements are independent of the type and nature of the reception devices (longitudinally movable or transversely movable). Preferably, it is possible to use the same components for the charging processes, irrespective of this condition—contact elements, contact element carrier, pivot part, connection element, receptacle for the latter, etc.

The device-side contact elements are advantageously arranged on an underside of the reception devices and the parking space-side contact elements preferably can be traveled over when the reception devices are moved.

The device-side contact elements can alternatively be arranged on one side of the reception device and the parking space-side contact elements, in particular on the pivot part, laterally at the parking space, wherein they can be passed laterally by the reception device during movement out of the parking space.

The reception devices comprise, for example, lanes for the motor vehicle, wherein the device-side contact elements are arranged below a lane, in particular below a ramp of the lane, at least partially.

In a preferred embodiment, the reception devices can comprise a first group of device-side contact elements and a second group of device-side contact elements, wherein the first group and the second group are formed symmetrically relative to each other with respect to an axis of symmetry extending through a center of the reception device and oriented transversely to a plane of the reception device. If the reception device is turned about a vertical axis, for example at the transfer position or on the transport device, the advantages can be achieved in both orientations of the reception device. No further contact elements are to be provided at the parking space for this purpose. Depending on the orientation of the reception device, the contact elements of the first group or of the second group can couple to the parking space-side contact elements.

The reception devices preferably comprise two connection elements and respective receptacles for these, wherein the receptacles are formed symmetrically to one another with respect to the axis of symmetry.

In the case of longitudinally movable reception devices, the first group and the second group of the contact elements can in particular be located diagonally opposite one another on the reception device.

In the case of transversely movable reception devices, the first group and the second group of contact elements can lie diametrically opposite one an-other with respect to the axis of symmetry, wherein the respective group in itself can be positioned symmetrically with respect to the central longitudinal plane.

The reception device preferably comprises an electrical control device which is coupled to both groups of contact elements, wherein the control device switches contact elements of the respective other group to a voltage-free state when the contact position of the contact elements of one group is assumed. This increases the electrical safety of the parking facility.

The reception devices can in particular be pallets.

In particular, it can be provided that more than two parking spaces arranged one behind the other are provided in the movement direction.

It can in particular be provided that the carrying device comprises more than one level with parking spaces.

Figure 9:
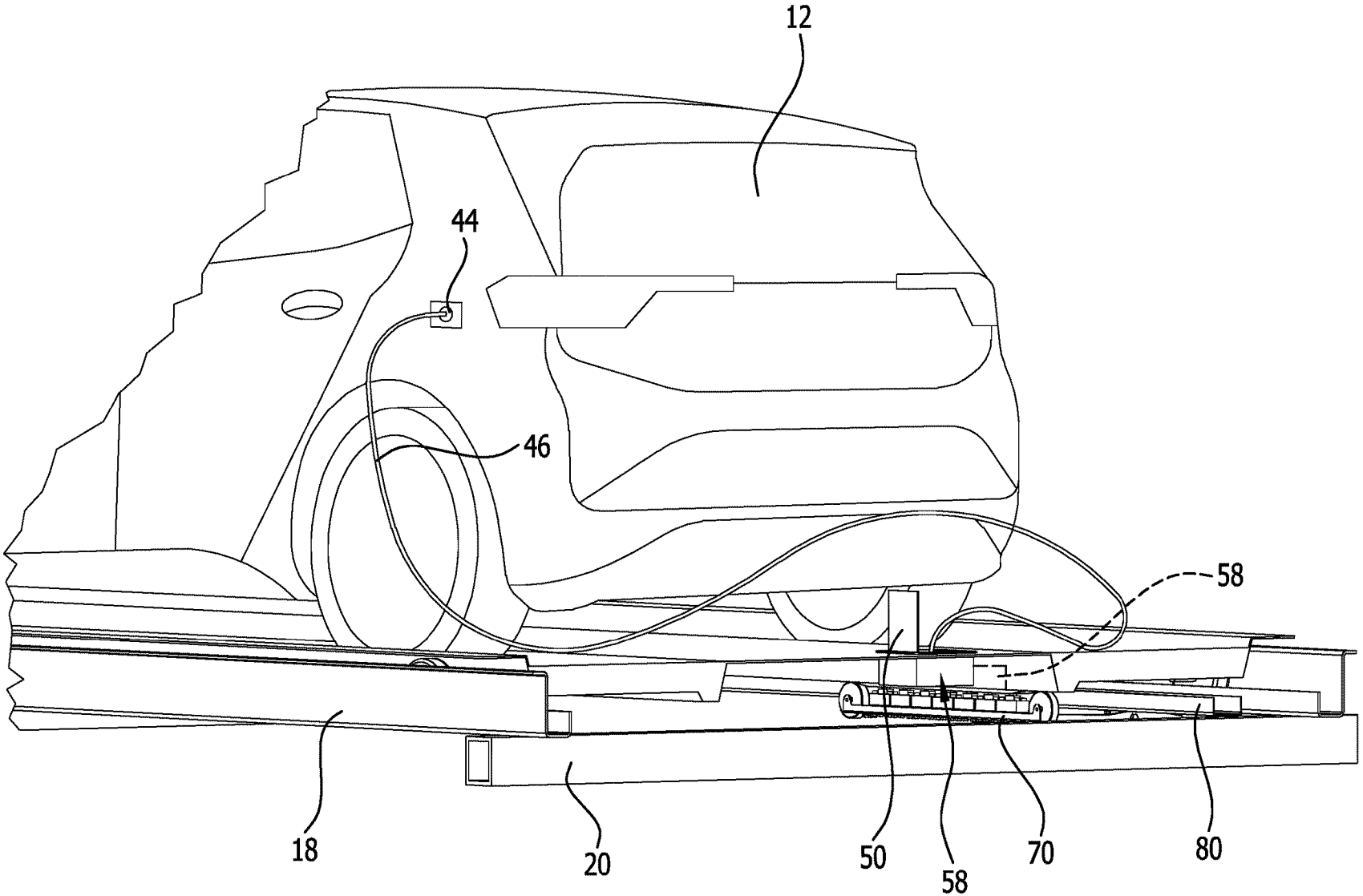
FIG. 9 is a schematic perspective depiction of a motor vehicle on a reception device which is electrically contacted and arranged in the parking space.

The following description of preferred embodiments serves in conjunction with the drawing to explain more detail. The following are shown:

FIG. 1 shows a schematic view of a partial depiction of an advantageous embodiment of a parking facility in accordance with the disclosure, which is assigned the reference numeral 10. The drawing shows a plan view of a level of the parking facility 10. It is understood that the parking facility 10 can comprise more than just one level with parking spaces for motor vehicles 12 (FIG. 9). The motor vehicles 12 (in the following vehicles 12) are in particular electrically operable and, for this purpose, have a battery (not shown in the drawing) which can be charged in a parking space in a parking position of the vehicle 12, as will be explained below.

The parking facility 10 comprises a carrying device 14, in the present case configured as a parking rack 16 with longitudinal carriers 18, transverse carriers 20 and vertical carriers extending in a height direction, which are not shown in the drawing for the sake of clarity.

In accordance with the disclosure, the parking rack 16 defines parking spaces 22 for the vehicles 12, which can assume a parking position in each case.

In the present preferred exemplary embodiment, two or more parking spaces 22 are arranged one behind the other in at least one level of the parking facility 10 in a movement direction 24. FIG. 1 shows by way of example two parking spaces 22 arranged one behind the other in the movement direction 24, wherein three of these pairs of parking spaces 22 are shown laterally next to one another. It is understood that more than two parking spaces 22 can be present in the movement direction 24 and further parking spaces 22 can be provided transversely thereto.

A dashed line 26 in FIG. 1 indicates a transport region of the parking facility 10, in the transport region 26 the vehicles 12 can be moved by means of a transport device that is known per se and is not shown in the drawing from a transfer position to a position in the parking space 22 and vice versa.

The vehicles 12 are positioned on reception devices 28 during transport and in the parking spaces 22. In the present case, the reception devices 28 are pallets 30. The pallets 30 are completely or substantially closed and have lanes 32 for the vehicle 12. In a manner known per se, rollers 34 can be held on the pallets 30 so that the pallets 30 can be moved into the parking spaces 22 and pushed out of the latter again.

In the present case, "pushing" can also be understood as "pulling" and can take place by a tensile force instead of a thrust force.

At the parking facility 10, the pallets 30 are longitudinally movable and have a longitudinal direction 36 and a transverse direction 38. The vehicle 12 is positioned along the longitudinal direction 36 on the pallet 30 as intended.

The movement direction 24 is oriented in the longitudinal direction 36 of the pallets 30 at the parking facility 10. Starting from the transport region 26, the pallets 30 can be moved in the movement direction 24 into the first row of the parking spaces 22 and can be pushed further out of the latter in the movement direction 24 into the second row of parking spaces 22.

An opposite movement direction indicated by an arrow 40 is assigned to the movement direction 24. In the movement direction 40, the pallets 30 can be moved out of the second row of parking spaces 22 into the first row of parking spaces 22 and from the latter into the transport region 26.

Accordingly, two movement directions 24, 40 are provided.

It is possible to connect several pallets 30 to one another in the longitudinal direction 36. For this purpose, coupling elements are present on transverse sides of the pallets 30 which are not depicted in the drawing for the sake of clarity. For example, pallets 30 are moved into the second row of parking spaces 22 by coupling them to pallets 30 that are pushed into the first row of parking spaces 22. This is known per se.

In the following, with reference in particular to FIGS. 2, 3, 8 and 9, the configuration of the pallets 30 is first discussed.

The pallets 30 comprise contact elements 42 which can be supplied with electrical energy. The contact elements 42 are device-side contact elements 42 in the sense of the present disclosure.

In the present case, seven contact elements 42 are provided. The contact elements 42 are formed for the purpose of energy transmission into a seven-pole connection element 44, in particular a so-called "type 2" connection element, which can be a plug or a socket.

Alternatively or in addition, a CEE connection element can be provided, for example.

It is understood that the present disclosure is not limited to these special connection systems. Another connection system and a different number of contact elements 42 can be provided. In the present example of the type 2 connection element, the contact elements 42 are used for the assignment of three outer conductor contacts (L1, L2, L3), a protective contact (PE), a neutral conductor (N), the proximity pilot (PP) and the control pilot (CP).

In the present case, the connection element 44 is a plug (FIG. 9) which is arranged on a connection cable 46. When not in use, the connection element 44 and the connection cable 46 can be stored in a receptacle 48. In order to pull in the connection cable 46, a retraction device can preferably be provided.

The receptacle 48 is arranged close to a transverse side of the pallet 30 and extends downward from its surface, so that the receptacle 48 does not protrude beyond the contour of the pallet 30. The receptacle 48 comprises a cover 50 which can be closed. In use, the cover 50 can be opened and the connection element 44 with the connection cable 46 can be taken out.

Alternatively or in addition, the connection element 44 can be arranged in the receptacle 48, and a user can connect an on-board connection cable to the connection element 44.

The contact elements 42 are indirectly connected to the connection element 44, via a control device 52 on the pallet 30. The reference numerals 54 and 56 indicate schematically electrical lines in FIG. 2, which in the present example are of seven-pole design.

The contact elements 42 are held on a contact element carrier 58. The contact element carrier 58 is fixed to the underside of the pallet 30, in the present example by screwing, wherein a different fixing is conceivable.

The contact element carrier 58 is preferably at least partially manufactured from an electrically insulating material, for example from a plastic material, in particular POM (polyoxymethylenes), PE (polyethylene) or PET (polyethylene terephthalate).

Figure 3:
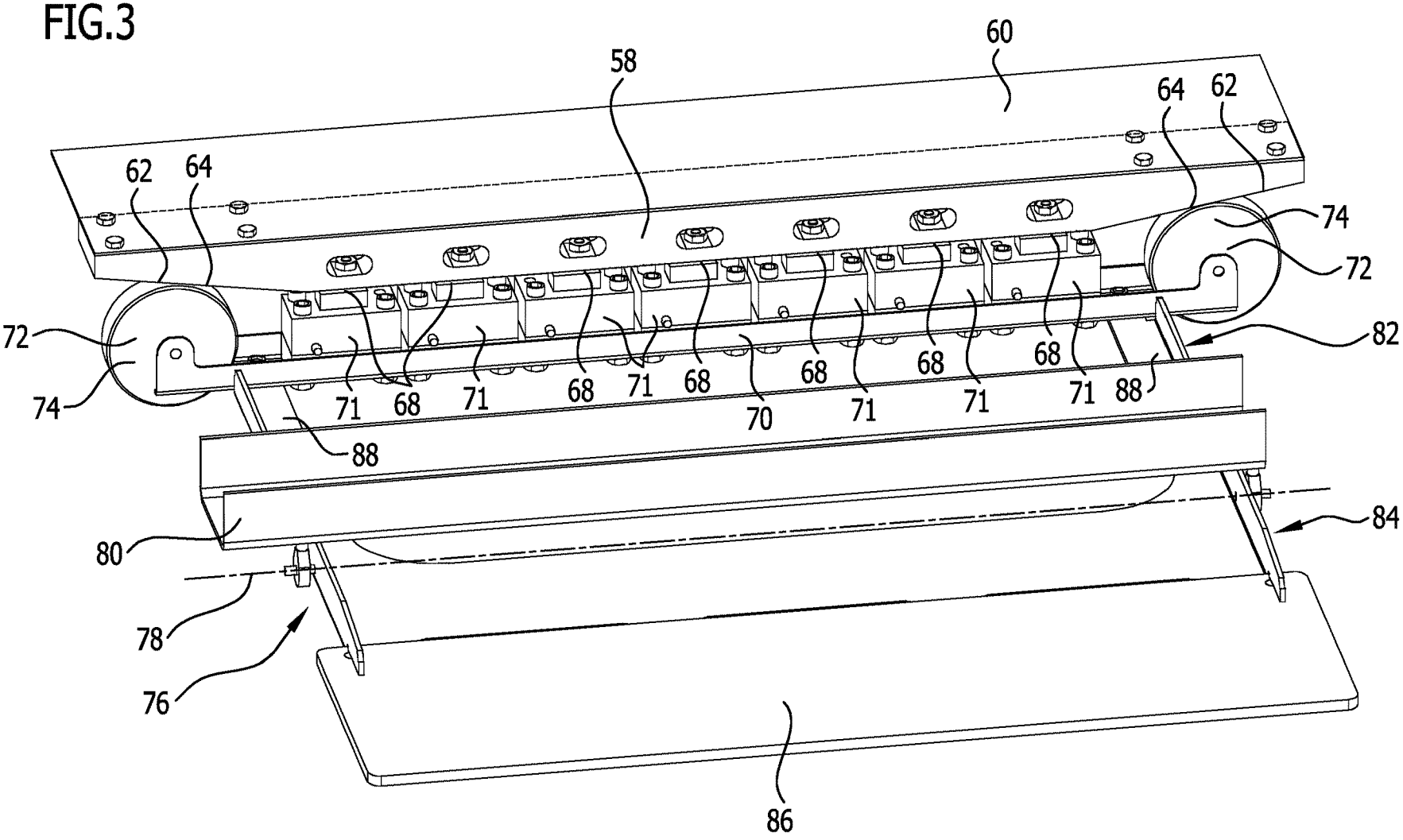
FIG. 3 is a perspective depiction of a contact element carrier of a reception device and of a contact element carrier at a parking space as well as a pivot part for the last-mentioned contact element carrier.
Figure 8:
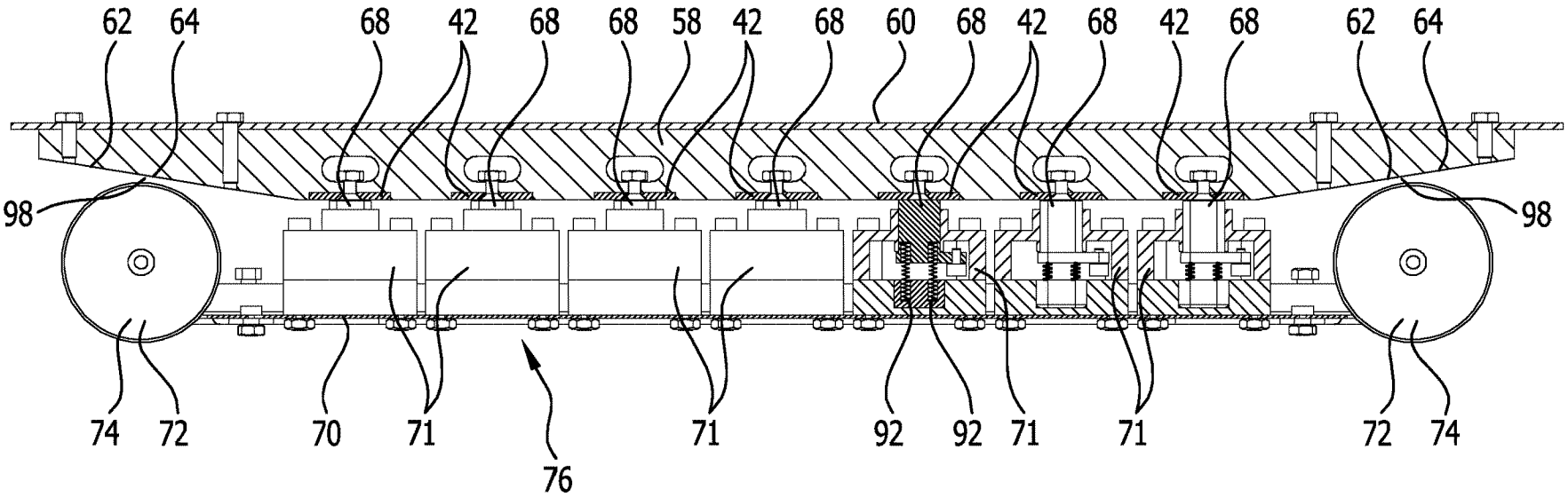
FIG. 8 is an enlarged depiction of Detail A in FIG. 6 in a partial view, partially as a sectional view.

FIGS. 3 and 8 show in portions a lower wall 60 of the pallet 30 on which the contact element carrier 58 is fixed.

The contact elements 42 are arranged next to each other in the longitudinal direction 36 and thus also in the movement direction 24 and opposite thereto, in particular in a straight line. In this way, the contact element carrier 58 is designed to extend longitudinally and occupies only a small installation space. The contact element carrier 58 is likewise oriented in the longitudinal direction 36 and the movement direction 24.

In the movement direction 24, the contact element carrier 58 has a coupling element 62 upstream of the contact elements 52. The coupling element 62 is configured as a ramp 64 which has an inclination relative to the movement direction 24.

On the opposite side, downstream of the contact elements 42 in the movement direction 24, the contact element carrier 58 has a further coupling element 42 in the form of a ramp 64. Both ramps 64 are in particular configured identically, but in their inclination opposite to each other. A respective ramp 64 rises starting from the contact elements 42 in the direction of the lower wall 60.

The contact element carrier 58 is arranged eccentrically with respect to a central longitudinal plane and to a central transverse plane of the pallet 30 and is positioned below the lane 32. In relation to the longitudinal direction 36, the contact element carrier 58 is located approximately in the region of one fifth of the extension of the pallet 30 starting from the closest transverse side.

The contact elements 42 form a first group of contact elements with a first contact element carrier 58.

Figure 2:
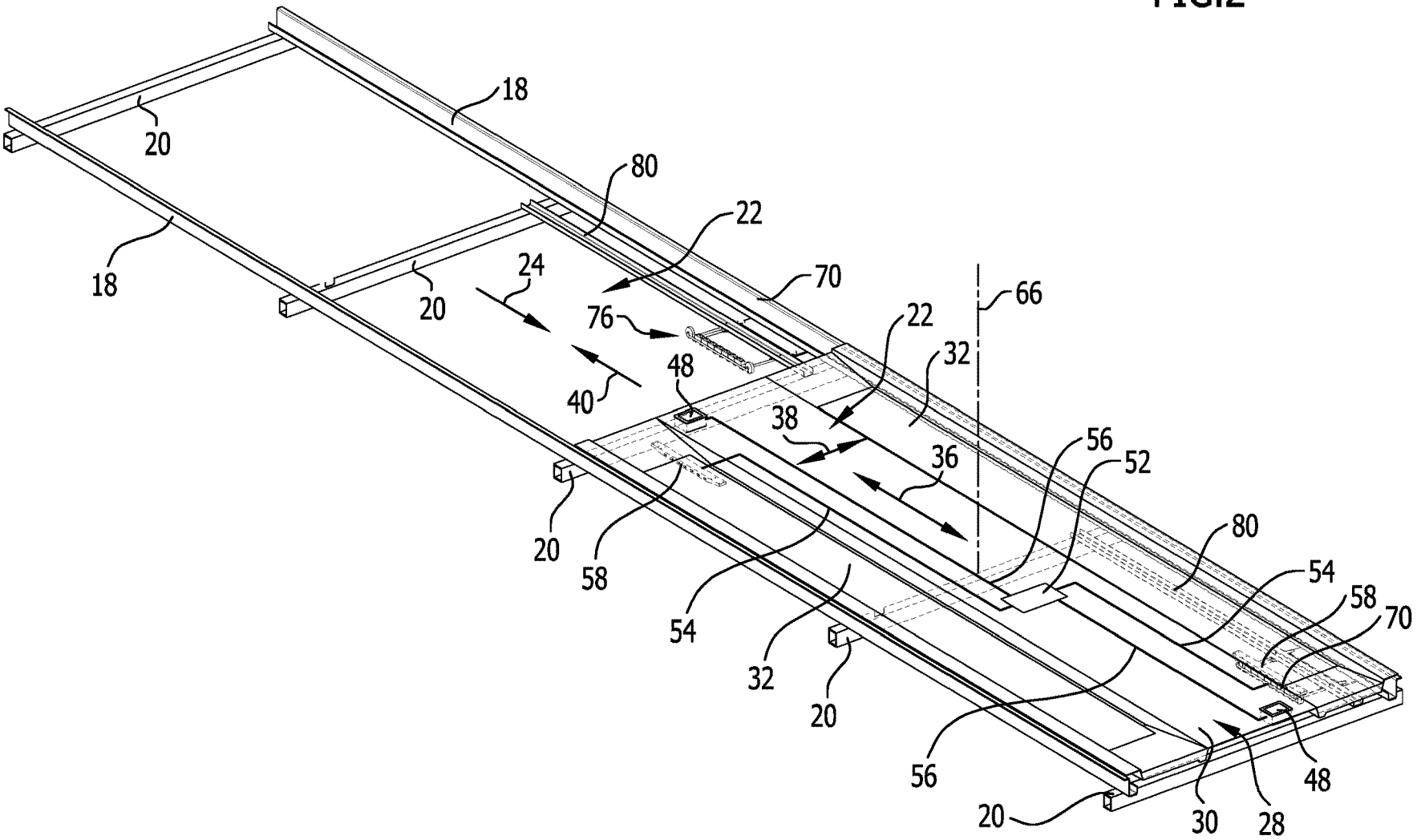
FIG. 2 is a perspective partial depiction of the parking facility in schematic view with two parking spaces arranged one behind the other in a movement direction and a reception device in a parking space.

As can be seen in particular from FIG. 2, the pallet 30 comprises a second group of contact elements 42 with a further contact element carrier 58. The first and the second group of contact elements 42 and the contact element carriers 58 are arranged and formed symmetrically relative to one another with respect to an axis of symmetry 66 on the pallet 30.

In a corresponding manner, two receptacles 58 with a connection element 44 and/or connecting cables which can be accommodated therein are provided in the pallet 30. The two receptacles 48 are likewise arranged symmetrically to one another on the pallet 30 with respect to the axis of symmetry 66.

The axis of symmetry 66 runs through the center of the pallet 30 transversely to the plane defined by the pallet 30. The position of the axis of symmetry 66 results from a section of a central longitudinal plane and a central transverse plane of the pallet 30.

The provision of two groups of contact elements 42 is advantageous because the pallets 30 can be rotated about the axis of symmetry 66 by means of a rotating device (not shown in the drawing) at the parking facility 10. As a result, the pallets 30 can be moved into the parking spaces 22 in two mutually opposite orientations. In both orientations, the contact elements 42 can electrically couple with the contact elements arranged on the parking spaces 22, which will be discussed later. Regardless of the orientation of the pallet 30, there is thus the possibility to charge the vehicle 12 arranged thereon.

The provision of two receptacles 48 with the connection element 44 facilitates the connection to the vehicle 12 for the user.

In the case of pallet 30 arranged in the parking space 22, only the first group of contact elements 42 or only the second group of contact elements 42 is supplied with energy. The respective other group of contact elements can be switched into a voltage-free state via the control device 52. The electrical safety is thereby increased.

Figure 6:
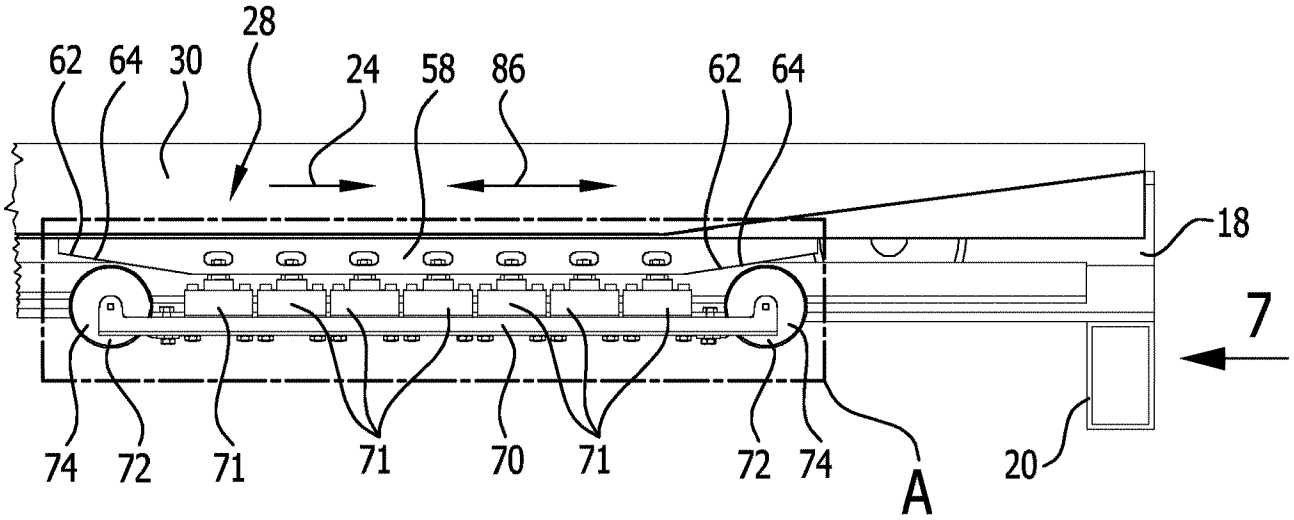
FIG. 6 is a depiction corresponding to FIG. 4 when the reception device assumes a parking position in the parking space and the contact elements assume a contact position.

In the following, with reference in particular to FIGS. 3, 5 and 6, the electrical contact elements 68 at the parking space 22 are discussed, which are parking space-side contact elements 68 in the sense of the present disclosure.

The contact elements 68 correspond to the contact elements 42. In the present case, seven contact elements 68 arranged in a straight line next to one another in the movement direction 24 and in the longitudinal direction of the parking space 22 are also present.

The contact elements 68 are held on a common contact element carrier 70 holding them and are each movably accommodated in a holding body 71. In the present case, the holding body 71 comprises a lower part and an upper part connected thereto.

The holding body 71 is preferably at least partially manufactured from an electrically insulating material, for example from a plastic material, in particular POM (polyoxymethylenes), PE (polyethylene) or PET (polyethylene terephthalate).

Coupling elements 72, which can couple to the coupling elements 62, are arranged on opposite sides on the contact element carrier 70. The coupling elements 72 are rollers 74 which can rotate about axes oriented transversely to the movement direction 24.

In the movement direction 24, the rollers 74 have a distance from one another which corresponds approximately to a distance of the center of the ramps 64 from one another in the longitudinal direction 36 (FIGS. 3 and 8).

The contact element carrier 70 is held on a pivot part 76, wherein the pivot part 76 is mounted on the carrying device 14 so as to be pivotable about a pivot axis 78. For this purpose, the carrying device 14 comprises a holding part 80, which connects two transverse carriers 20 (FIGS. 1 and 2) and runs parallel to the longitudinal carrier 18.

The pivot axis 78 is aligned in the movement direction 24.

The pivot part 76 is configured as a two-armed lever with a first segment 82 on which the contact element carrier 70 is held, and a second segment 84 on which a counterweight 86 for the contact element carrier 70 is held. The segments 82, 84 are arranged on opposite sides of the pivot axis 78.

The counterweight 86 is arranged approximately below a longitudinal carrier 18. In the present case, the segment 82 is divided into two spaced-apart legs 88 for weight saving.

Electrical lines, not depicted in the drawing, for contacting the contact elements 68 can be arranged on the pivot part 76. The electrical lines are connected to an electrical switching device 90 (FIG. 1) arranged on the parking rack 16. The switching device 90 can in particular be a so-called "Wallbox" for supplying the type 2 connection elements 44.

As can be seen in particular in FIGS. 4 to 7, the pallet 30 is arranged above the pivot part 76 when a parking position is assumed in the parking space 22. In particular, the contact elements 68 are arranged below the contact elements 42.

The contact elements 68 are arranged movably on the parking space 22, namely pivotable about the pivot axis 78. In contrast, in the present example, the contact elements 42 are held stationary and in particular immovably on the pallet 30.

The torque exerted by the segment 82 with the contact element carrier 70 is, without external force, less than the torque exerted by the segment 84 with the counterweight 86. In this way, the counterweight 86 pulls the segment 84 downwards and thus the contact elements 68 upward, wherein they assume a base position.

By exerting a force directed downwards on the contact element carrier 70, the pivot part 76 can be pivoted about the pivot axis 78 against the resetting action of the counterweight 86, in particular in order to transfer the contact elements 68 into a contact position. This is explained below.

If the pallet 30 is moved into the parking space 22 in the movement direction 24, the contact elements 42 and 68 are not yet in contact with one another and assume a base position. The base position is in particular the base position of the movable contact elements 68, since the contact elements 42 are held immovably on the pallet 30. By moving the pallet 30 into the parking space 22, the contact elements 42, 68 can be transferred into a contact position in which they are in electrical contact with one another. The contact position is in particular a contact position of the movable contact elements 68 because the contact elements 42 are held immovably on the pallet 30.

Figure 4:
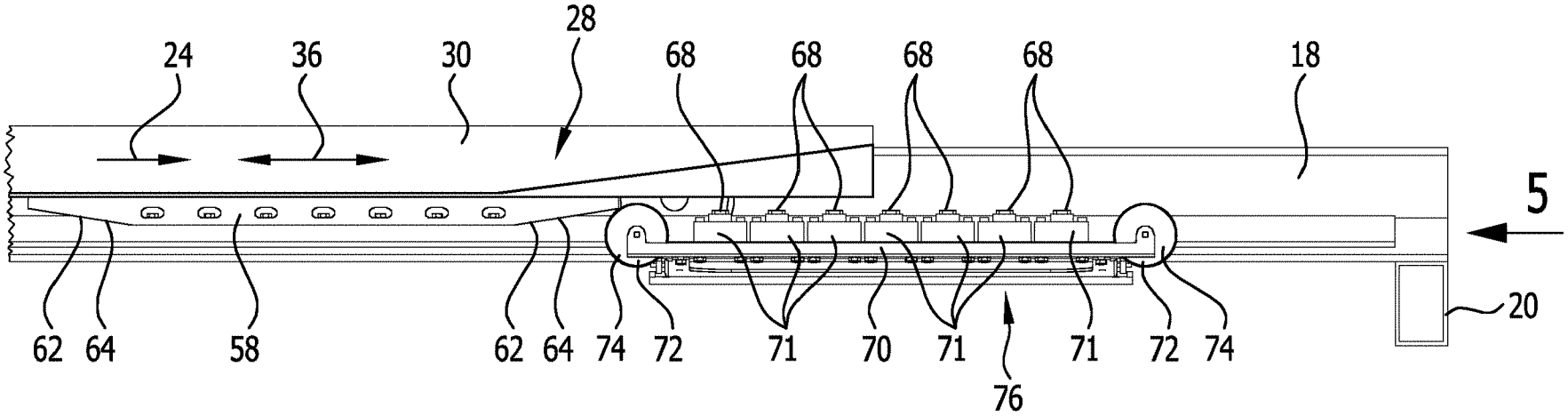
FIG. 4 is a schematic side view of the contact element carrier and the reception device when it is moved into the parking space, wherein contact elements at the parking space assume a base position.
Figure 5:
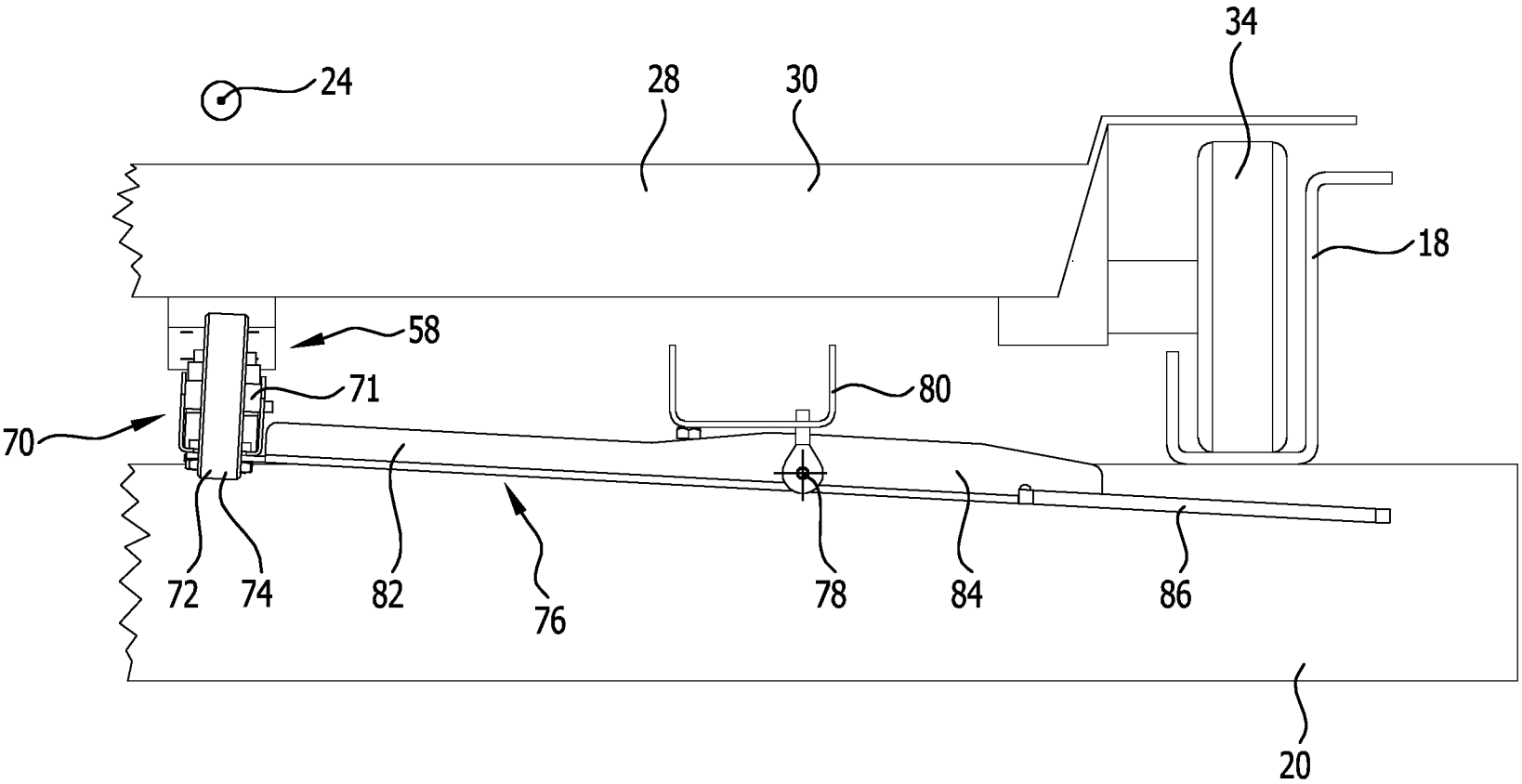
FIG. 5 is a view in the direction of the arrow "5" in FIG. 4.

When the pallet 30 is moved in, the contact elements 42, 68 assume the base position as long as the ramp 64 leading in the movement direction 24 does not couple with the roller 74 that is initially facing the pallet 30 (FIGS. 4 and 5).

When the pallet 30 is moved further, the roller 74 comes to bear against the ramp 64 and acts as a run-on element. The roller 74 is subjected to a force that is transverse to the movement direction 24 and directed in particular downward.

As a result, the contact element carrier 70 is pressed downwards, and the pivot part 76 is pivoted about the pivot axis 78.

When the pallet 30 is moved further, the roller 74 rolls on the ramp 64 and then over the contact elements 42, which are pushed over it.

Figure 7:
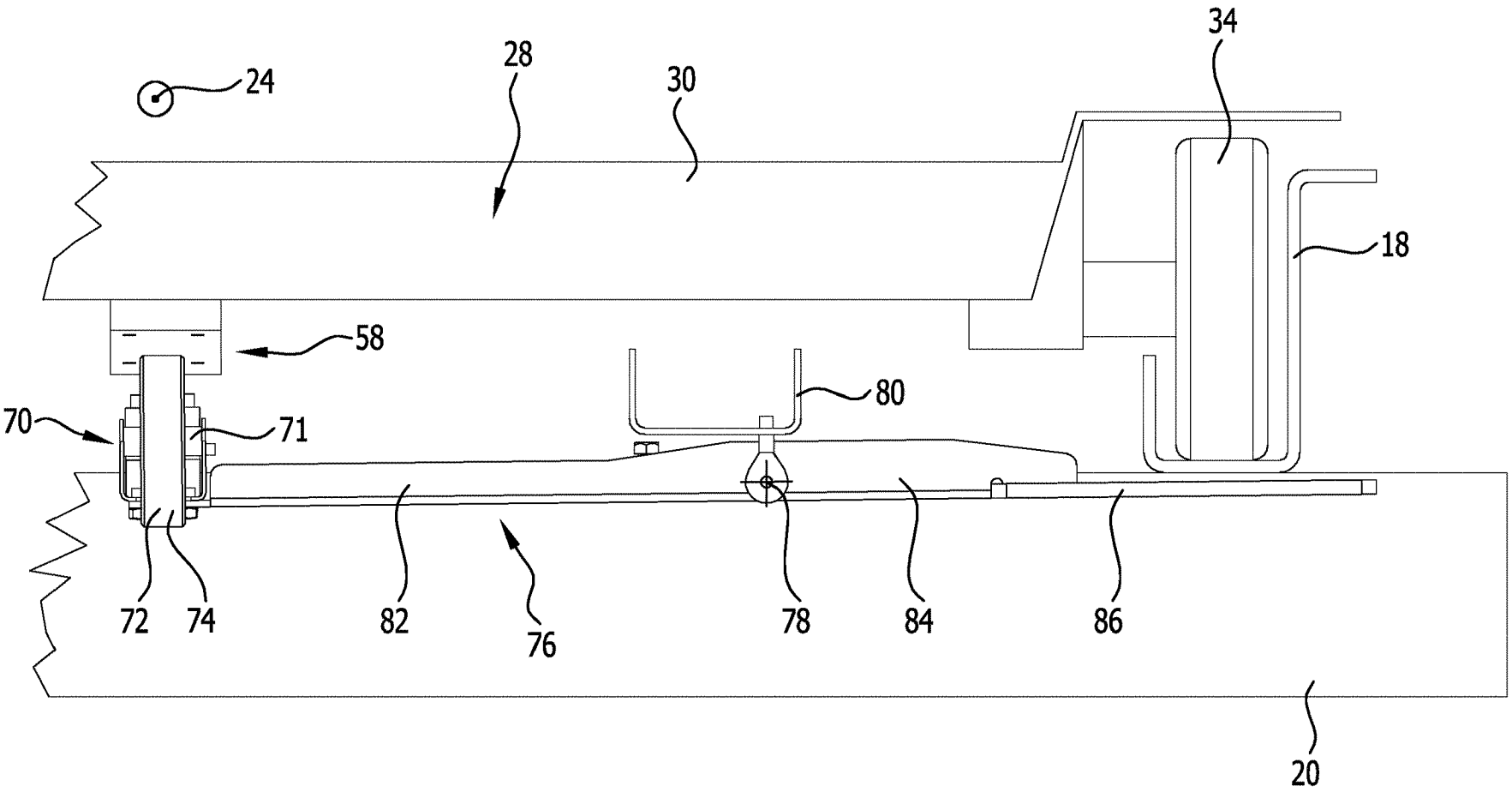
FIG. 7 is a depiction in the viewing direction of the arrow "7" in FIG. 6.

When the pallet 30 assumes its target position in a parking position, the contact elements 42, 68 assume the contact position. The contact elements 68 abut against the contact elements 42 from below (FIGS. 6 and 7).

The contact elements 68 are configured in the shape of a pin and are pretensioned by means of pretensioning elements 92 in the holding body 71 in the direction of the contact elements 42 in the present case (FIG. 8). In this way, a reliable electrical contact can be provided in the contact position.

Accordingly, the contact elements 42, 68 can be transferred from the base position into the contact position by moving the pallet 30. A drive is not required.

The assumption of the parking position can be detected by means of a detection device 94, for example optically. A signal in this regard can be supplied to a control device 96 of the parking facility 10.

The control device 96 is coupled to the switching device 90. The control device 96 can actuate the switching device 90 as a function of the signal of the detection device 94. The connection element 44 can be supplied with electrical energy via the contact elements 68 and 42 and the battery of the vehicle 12 can thus be charged.

As can be seen in particular from FIG. 8, the rollers 74 and the ramps 64 have a distance from one another in the contact position of the contact elements 42, 68. The intermediate space 98 in this regard can be, for example, a few millimeters to a few centimeters.

The provision of the space 98 has the following advantage. If the pallet 30 is moved out of the parking space 22 or moved therein, the contact elements 68 slide over the contact elements 42 in the direction 24 and/or the direction 40. As a result, any adhering impurities are removed, and the long-term reliable electrical contacts can be ensured.

The contact elements 42, 68 are configured to be moved relative to one another starting from the contact position when the pallet 30 is moved out of the parking space 22 in the movement direction 24. Therefore, if the pallet 30 is moved into a further, downstream parking space 22 in the movement direction 24, the contact of the contact elements 42, 68 can be canceled in particular by the movement of the pallet 30.

When the pallet 30 is moved further, the ramp 64 leading in the movement direction 24 comes to rest against the roller 74 at the rear in the parking space 22. The roller 74 rolls over the rest of the ramp 64 and the contact elements 42 and subsequently over the ramp 64 trailing in the movement direction 24.

The action of the counterweight 86 pivots the pivot part 76 again, and the contact elements 68 are transferred back into the base position.

In this case too, the movement of the contact elements 42, 68 relative to one another is carried out solely by the movement of the pallet 30. A drive is not required.

As a result of the configuration described above, the contact elements 68 can be traveled over by the pallet 30 at the parking space 22.

Usually, a pallet 30 to be stored is first moved into a (front) parking space 22 leading in the movement direction 24 when the vehicle 12 is to be charged. If a further vehicle 16 is to be stored in the same parking grid, the control device 96 can interrupt the charging operation. Subsequently, the pallet 30 is moved into the next parking space 22 in the movement direction 24, and the released parking space 22 can be equipped with a further pallet 30. The charging process for the first vehicle 12 can be continued and the charging process for the second vehicle 12 can be started.

If it is foreseeable that, immediately after the vehicle 12 was moved into the first parking space 22, a further vehicle 12 is to be stored in the same parking grid, it is possible, for example, to deviate from the above procedure in order to avoid brief charging processes. For example, it is possible to wait until the pallets 30 of both vehicles 12 assume the parking positions before both switching devices 90 are activated.

Both during movement in the movement direction 24 and in the opposite direction, during movement in the movement direction 40, the contact elements 68 can each be traveled over by the pallets 30. In this case, the contact elements 68 are initially transferred from the base position into the contact position and back into the base position. If no charging process is provided at a specific parking space 22, the pallet 30 is moved through the parking space 22, and the rollers 74 only roll off via the ramps 64 and the contact elements 42.

In general, the pallet 30 can be moved past the contact elements 68 in both movement directions 28, 40 through the parking spaces 22.

Figure 10:
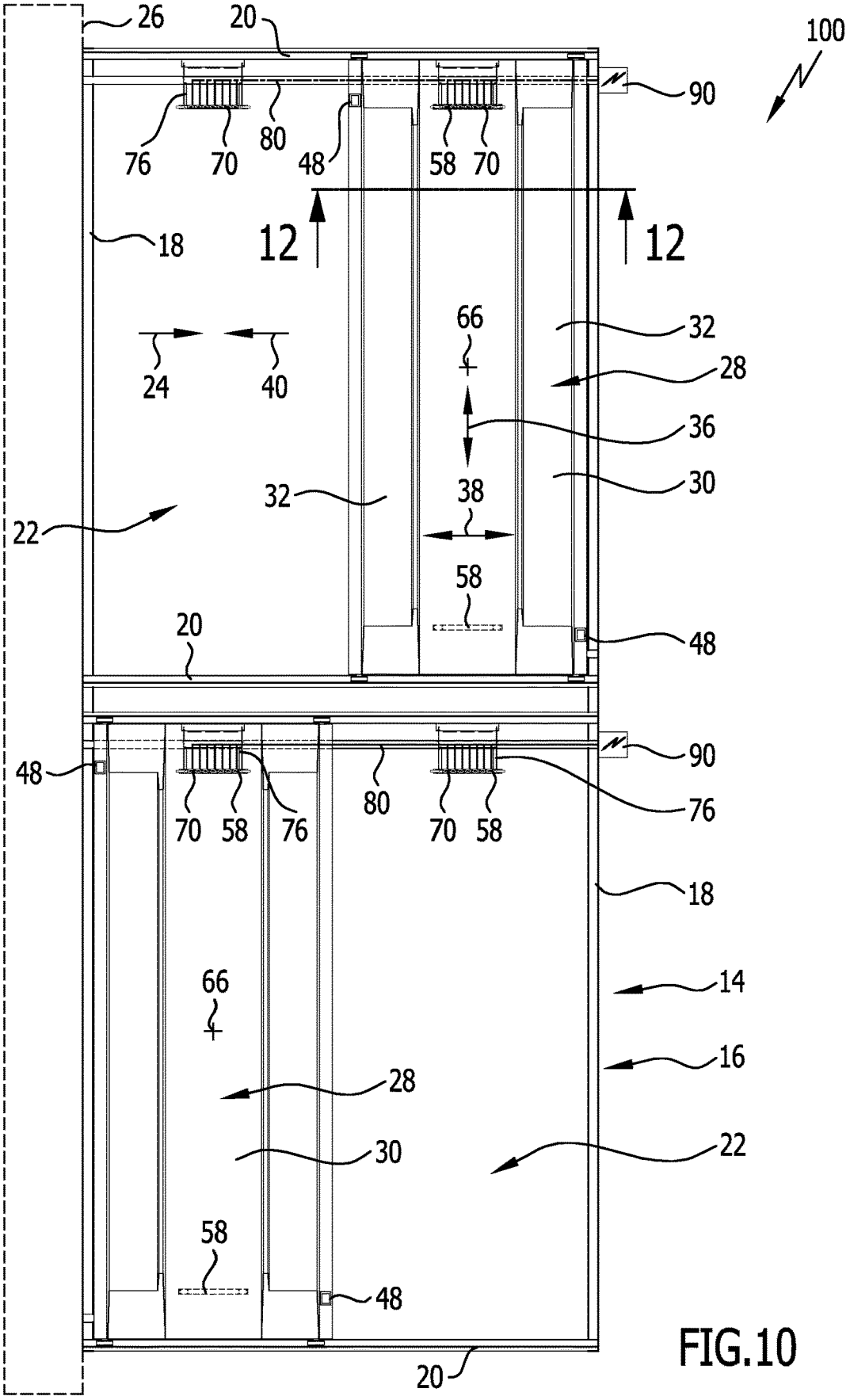
FIG. 10 is a depiction corresponding to FIG. 1 in a further preferred embodiment of the parking facility in accordance with the disclosure.
Figure 11:
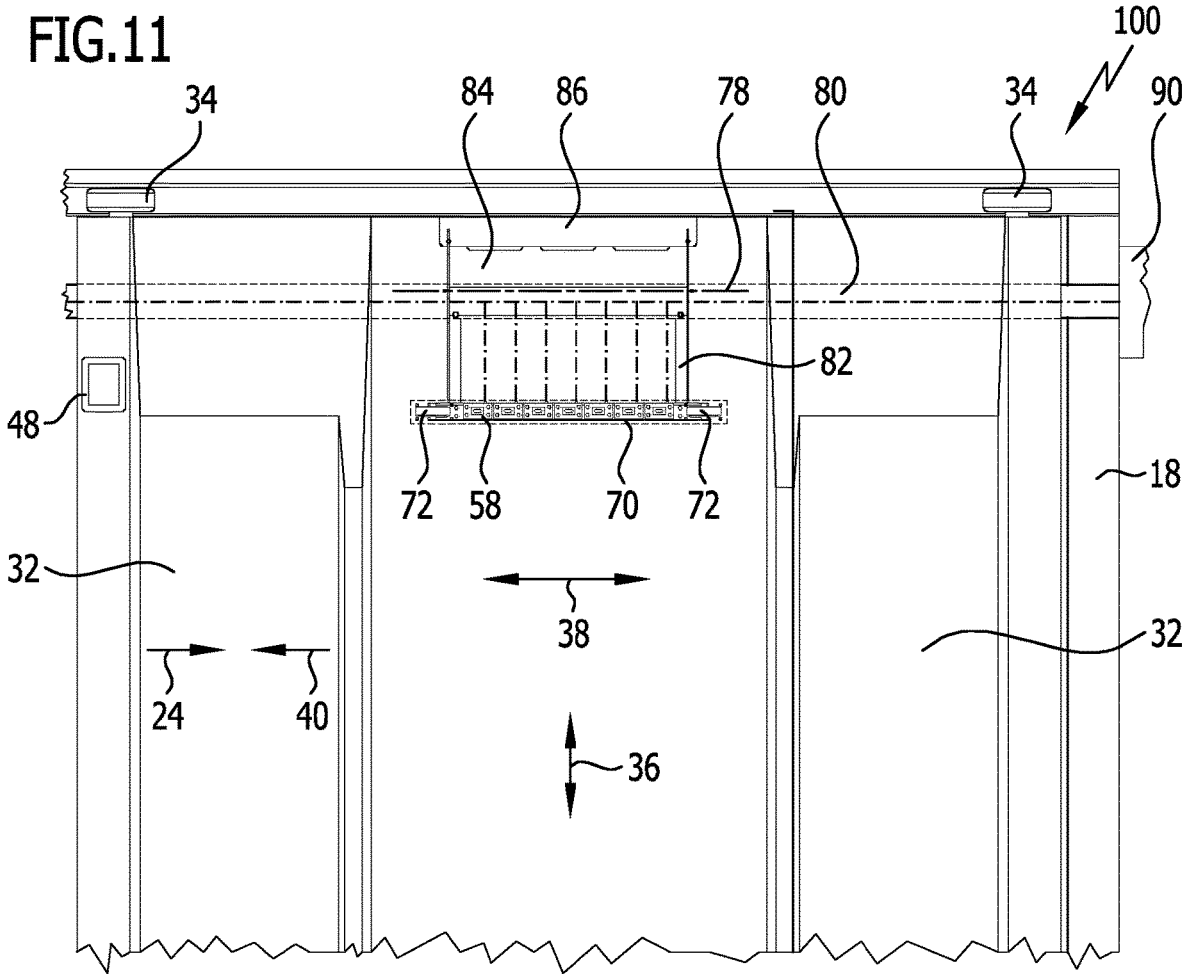
FIG. 11 is an enlarged depiction of the region of the parking facility depicted above the line 12-12 in FIG. 10.
Figure 12:
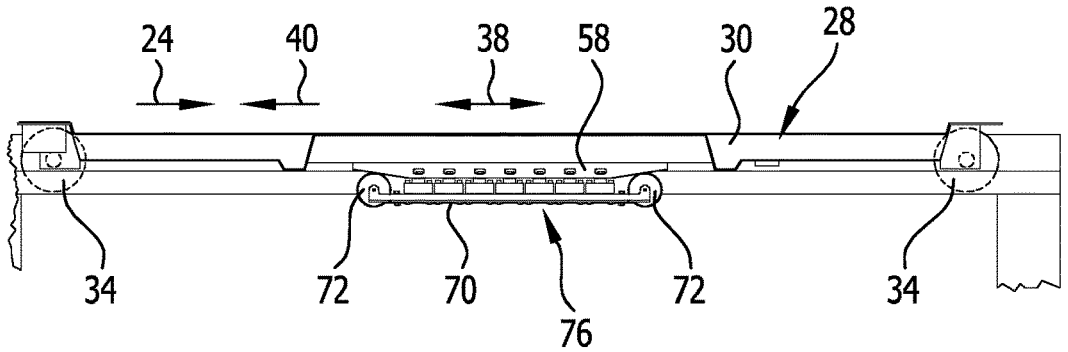
FIG. 12 is a sectional view along line 12-12 in FIG. 10.

FIG. 10 shows an advantageous embodiment of the parking facility in accordance with the disclosure, designated by the reference numeral 100. Identical reference numerals are used for identical or like-acting features and components of the parking facilities 10, 100. The advantages achievable with the parking facility 10 can also be achieved with the parking facility 100, so that reference can be made to the preceding explanations in this respect.

In the case of the parking facility 100, pallets 30 are used, which are transversely movable. The movement direction 24 is oriented in the transverse direction 38.

The contact elements 42 are arranged via the contact element carrier 58 such that they are positioned next to one another along the transverse direction 38. In addition, a first group and a second group of contact elements 42 are also provided in this case, which are symmetrical with respect to the axis of symmetry 66. Within each group, the contact elements 42 are positioned symmetrically with respect to a central longitudinal plane on the pallet 30.

The receptacle 48 is arranged on the longitudinal side of the pallet 30.

The pivot part 76 is positioned on a transverse side of the parking space 22. The contact element carrier 70 with the contact elements 68 is aligned in the transverse direction 38 of the parking space 22, wherein the contact elements 68 are arranged next to one another in the movement direction 24.

The contact elements 42, 68 can also be transferred from a base position into a contact position at the parking facility 100. They are further configured to be brought out of contact with the contact position, wherein the pallet 30 can be moved further in the movement direction 24 out of the parking space 22. In particular, the contact elements 68 can be traveled over in the parking space 22 by the pallet 30 moved in the movement direction 24.

The same applies to the movement in the opposite movement direction 40.

The invention claimed is:

1. A parking facility for motor vehicles, comprising:

a carrying device having parking spaces for the motor vehicles, wherein parking spaces are arranged in at least one level of the parking facility, reception devices for the motor vehicles, which are movable in at least one movement direction relative to a respective parking space into a parking position in the parking space and out of the parking position in the parking space, parking space-side contact elements arranged on at least some parking spaces, which contact elements are suppliable with electrical energy, arranged on at least some reception devices, corresponding device-side contact elements and a connection element electrically coupled thereto for connecting to a motor vehicle positioned on the reception device, wherein at least one of the parking space-side contact elements are arranged movably on the carrying device and the device-side contact elements are arranged movably on the reception device, with the moveable contact elements being configured to be moved from a base position in the absence of the reception device in the parking space into a contact position when the reception device assumes the parking position, in which contact position the corresponding contact elements are electrically coupled to one another, and to be brought out of contact from the contact position, and wherein the reception device is movable in the at least one movement direction out of the parking space, wherein the parking space-side contact elements are assigned a contact element carrier on which the contact elements are held, and which is held on the carrying device, and wherein the contact element carrier is held on a pivot part which is pivotably mounted on the carrying device about a pivot axis.

2. The parking facility according to claim 1, wherein two or more parking spaces are arranged one behind the other along at least one movement direction, and wherein the reception device is movable past the parking space-side contact elements during movement out of the parking space.

3. The parking facility according to claim 1, wherein two movement directions are provided which are directed opposite one another, and wherein the reception device is movable past the parking space-side contact elements when being moved out of the parking space along each of the movement directions.

4. The parking facility according to claim 1, wherein the moveable contact elements are movable from the contact position to the base position when the reception device is moved out of the parking space.

5. The parking facility according to claim 1, wherein at least one of the parking space-side contact elements and the device-side contact elements are movable from the base position into the contact position and/or out of the contact position by moving the reception device.

6. The parking facility according to claim 5, wherein at least one of the parking space-side contact elements and the device-side contact elements are movable from the base position into the contact position and/or out of the contact position without a drive.

7. The parking facility according to claim 1, wherein only the parking space-side contact elements are arranged movably on the carrying device or only the device-side contact elements are arranged movably on the reception device, whereas the respective other contact elements are arranged in a stationary manner on the carrying device or on the reception device.

8. The parking facility according to claim 1, wherein the parking space-side contact elements and the device-side contact elements are pretensioned relative to one another in the contact position, wherein pretensioning elements are assigned to the parking space-side contact elements.

9. The parking facility according to claim 1, wherein corresponding contact elements in the contact position rub against each other in a contacting manner when the reception device is moved into the parking position and/or out of the parking position.

10. The parking facility according to claim 1, wherein several of the or all of at least one of the parking space-side contact elements and device-side contact elements are positioned next to one another in a straight line along the movement direction.

11. The parking facility according to claim 1, wherein the reception devices comprise a contact element carrier on which the device-side contact elements are held.

12. The parking facility according to claim 1, wherein the pivot axis is aligned along the at least one movement direction.

13. The parking facility according to claim 1, wherein the pivot part is pivotable relative to the carrying device by the movement of the reception device in the at least one movement direction.

14. The parking facility according to claim 1, wherein the pivot part is pivotable against the action of a resetting device.

15. The parking facility according to claim 1, wherein the pivot part comprises two segments arranged on opposite sides of the pivot axis, wherein the contact element carrier is arranged on a first segment and a second segment has or forms a counterweight for the contact element carrier, and wherein the contact element carrier is pivotable against the resetting action of the counterweight.

16. The parking facility according to claim 1, wherein a coupling element is arranged on the reception device upstream of the device-side contact elements in at least one movement direction, and a corresponding coupling element is arranged on the parking space-side contact elements, which coupling elements couple when the reception device is moved in the movement direction into the parking space in order to move the contact elements from the base position into the contact position.

17. The parking facility according to claim 16, wherein the coupling elements comprise a ramp and a run-on element which is abuttable against the ramp.

18. The parking facility according to claim 17, wherein the run-on element is a roller rolling on the ramp.

19. The parking facility according to claim 17, wherein the ramp is arranged on the reception device, in particular on its contact element carrier, and that the roller is arranged on the parking space, in particular on its contact element carrier.

20. The parking facility according to claim 16, wherein the coupling elements are spaced apart from one another when the contact position is assumed by the contacting elements and only come into contact again after the reception device has been moved relative to the parking space.

21. The parking facility according to claim 16, wherein a further coupling element is arranged on the reception device leading the device-side contact elements in an opposite movement direction and a corresponding further coupling element is arranged on the parking space-side contact elements, which coupling elements couple when the pallet is pushed into the parking space in this further movement direction in order to move the contact elements from the base position into the contact position.

22. The parking facility according to claim 1, wherein the parking facility comprises a control device and a detection device, by means of which the assumption of the parking position of the reception device in the parking space is determinable, and wherein the control device activates, as a function thereof, an electrical switching device arranged on the carrying device for supplying the parking space-side contact elements with electrical energy.

23. The parking facility according to claim 1, wherein the reception devices comprise a receptacle for the connection element, in which receptacle the connection element is arranged and in which receptacle a connection cable for connection to the motor vehicle is storable.

24. The parking facility according to claim 1, wherein the reception devices comprise longitudinally movable reception devices, wherein the at least one movement direction runs in a longitudinal direction of the reception devices, and wherein the device-side contact elements are arranged next to one another in the longitudinal direction.

25. The parking facility according to claim 1, wherein the reception devices comprise transversely movable reception devices, wherein the at least one movement direction runs in a transverse direction of the reception devices, and wherein the device-side contact elements are arranged next to one another in the transverse direction.

26. The parking facility according to claim 1, wherein the device-side contact elements are arranged on an underside of the reception device, and wherein the parking space-side contact elements are traveled over when the reception device is moved, or wherein the device-side contact elements are arranged on one side of the reception device, and the parking space-side contact elements are arranged, on the pivot part, laterally on the parking space and are passable laterally by the reception device during movement out of the parking space.

27. The parking facility according to claim 1, wherein the reception devices comprise lanes for the motor vehicle and wherein the device-side contact elements are arranged below a lane, or below a ramp of the lane.

28. The parking facility according to claim 1, wherein the reception devices comprise a first group of device-side contact elements and a second group of device-side contact elements, wherein the first group and the second group are formed symmetrically relative to each other with respect to an axis of symmetry extending through a center of the reception device and oriented transversely to a plane of the reception device.

29. The parking facility according to claim 28, wherein the reception device comprises an electrical control device which is coupled to both groups of contact elements, and wherein the control device switches the contact elements of the respective other group to a voltage-free state when the contact position of the contact elements of one group is assumed.

30. The parking facility according to claim 1, wherein the reception devices are pallets.

31. The parking facility according to claim 1, wherein the carrying device comprises more than one level with parking spaces.

* * * * *